US005742950A

United States Patent [19]

Chang

[11] Patent Number: 5,742,950

[45] Date of Patent: Apr. 28, 1998

[54] APPARATUS FOR PRESSURE ASSISTED FLUSH TOILETS

[76] Inventor: Shih-Chih Chang, 2339 Davison Ave., Richland, Wash. 99352

[21] Appl. No.: 708,953

[22] Filed: Sep. 6, 1996

[51] Int. Cl.[6] ..... E03D 1/18; E03D 3/06

[52] U.S. Cl. ..... 4/334; 4/354; 4/359; 137/414

[58] Field of Search ..... 4/334, 335, 336, 4/354, 359, 362, 366, 367; 137/413, 414, 456, 461

[56] References Cited

U.S. PATENT DOCUMENTS

| | | | |
|---|---|---|---|
| 880,594 | 3/1908 | Stickdorn | 4/359 |
| 918,216 | 4/1909 | Stickdorn | 4/334 |
| 957,028 | 5/1910 | Bassett et al. | 4/334 |
| 985,952 | 3/1911 | Stickdorn | 4/334 |
| 2,854,994 | 10/1958 | Glasgow | 137/414 |

*Primary Examiner*—Robert M. Fetsuga
*Attorney, Agent, or Firm*—Floyd E. Ivey

[57] ABSTRACT

An apparatus for pressure assisted flush toilets that comprises an air tight enclosed flush tank, a feed valve, a volume control device and a flush valve. The flush tank is normally empty when it is not in use. A push on the feed valve starts a flush cycle by feeding the flush tank with pressurized supply water. The incoming feed water fills the flush tank and at the same time compresses the entrapped air therein. When the tank is filled to the desired volume, the volume control device triggers to close the feed valve and opens the flush valve. Then the pressure of the compressed air in the flush tank discharges the water to the toilet bowl. The discharging water stream from the flush tank cleans the toilet bowl. After the flush the flush tank remains empty until next use.

4 Claims, 4 Drawing Sheets

APPARATUS FOR PRESSURE ASSISTED FLUSH TOILETS

BACKGROUND OF THE INVENTION

Most domestic flush toilets use an open flush tank to store sufficient water for its flushing system. After each flush, the flush tank is refilled with water to the desired level for its next use. There are several simple mechanisms that make the conventional flush toilet work. The trip lever starts the flush cycle by lifting open the flush valve. Water rushes to the toilet bowl to clean the waste. When the tank water is nearly empty the flush valve closes to isolate the flush tank. Then, the float valve refills the flush tank to a predetermined level.

The basic design philosophy in the existing toilet is to making the water immediately available for the next flush. There are many deficiencies associated with this design philosophy. The most common trouble is continuous water leak from the flush tank to the toilet bowl through the flush valve. The leak problem of existing toilets not only causes inconvenience to its users but also wastes significant amounts of water.

The pressure assisted flush system takes advantage of the existing pressure energy of the water supply, which significantly improves toilet performance. The existing pressure assisted toilets use the same flush cycle as the conventional gravity flush toilets. They have an enclosed flush tank that is constantly filled with water and compressed air between use. When the user activates the flush cycle, a trigger opens the tank discharge valve that sends the pressurized water stream immediately to the bowl. The discharge valve closes automatically when the flush tank water is nearly empty. At this point, the refill of the flush tank starts until a pre-determined pressure in the flush tank is reached. This design requires rather sophisticated control mechanisms and complicated components to make it work. As a result, the cost of its manufacturing is relatively high. A pressure assisted toilet is currently priced about twice of the conventional toilet of the same quality. Because the flush tank and most key components are constantly under pressure and in contact with water, the system has serious maintenance problems.

The present disclosure specifies an apparatus for flush toilets that uses the combination of a pressure assisted flush and new flush cycle. This combination provides high performance and at the same time eliminates the maintenance problems of the convention toilets.

OBJECTS OF THE INVENTION

The main object of the disclosed invention is to provide an apparatus for toilet working with pressure assisted flush and with a flush cycle that does not require water storage between uses.

A specific object of the disclosed invention provides a flush system that starts with water filling to the enclosed flush tank. The incoming water compresses the entrapped air in the flush tank. When water fills the flush tank to a predetermined volume, the flush system automatically shuts off the feed water and discharges the pressurized water from the flush tank to the toilet bowl. After the flush the flush tank remains empty until its next use.

Another specific object of the disclosed invention is to provide a pressure assisted flush apparatus that uses the combination of volume control and low flow shut off to accomplish a flush cycle.

INVENTION DISCLOSURE

The disclosed toilet consists of a toilet bowl for receiving the waste, an air-tight enclosed flush tank for contain water and compressed air, a feed valve connected to the pressurized water supply for starting a flush cycle and controlling the feed flow, a flush valve for controlling the water discharge from the flush tank to the toilet bowl, and a flush volume control device for controlling the water volume per flush.

The feed valve is normally closed to isolate the flush tank from the water supply. The feed valve has a trigger means for starting the flush cycle. The feed valve is so designed that once it is actuated, it stays open as long as the flow rate through the valve is substantial high and it closes automatically when the through flow rate drops to a predetermined low flow threshold.

The flush volume control device is so designed that it reduces the feed flow rate below the predetermined low flow threshold when tank is filled to the desired level. The flow reduction by the volume control device causes the feed valve to close, which shuts of the feed flow to the flush tank.

The flush valve controls the flush flow from the flush tank to the toilet bowl in such a manner that the flush valve closes when feed flow is on and it opens when the feed flow is stopped. This allows the feed water to be accumulated in the flush tank to as long as the feed flow is on. Then it discharges the accumulated water to the toilet bowl after the feed flow is shut off. After a flush, the flush valve remains open, the flush tank remains empty, and the feed valve remains closed until next use.

The unique flush cycle of the disclosed invention can be described sequentially in the following operational modes:

1. The idling mode (when the flush system is not used): The feed valve is closed, which isolates the water supply, the flush tank is empty and it remains empty until a flush cycle is triggered.

2. The feed mode: The feed valve is triggered to open manually that sends supply water to the flush tank. In this mode the flush valve is closed and the closure of the flush valve entraps a full tank of air. The incoming feed water is accumulated continuously in the flush tank until the predetermined water volume is reached.

3. Flow reduction mode: When predetermined water is accumulated in the flush tank, the volume control device reduces the feed flow below a predetermined low flow threshold.

The flush mode: Reacting to the feed flow reduction, the feed valve closes automatically. Subsequently, the flush valve opens to discharge the tank water to the toilet bowl. The flush continues until the flush tank is emptied. This return to the idling mode and the flush system is ready to be used again.

DESCRIPTION OF THE PREFERRED EMBODIMENT

Figure 1:
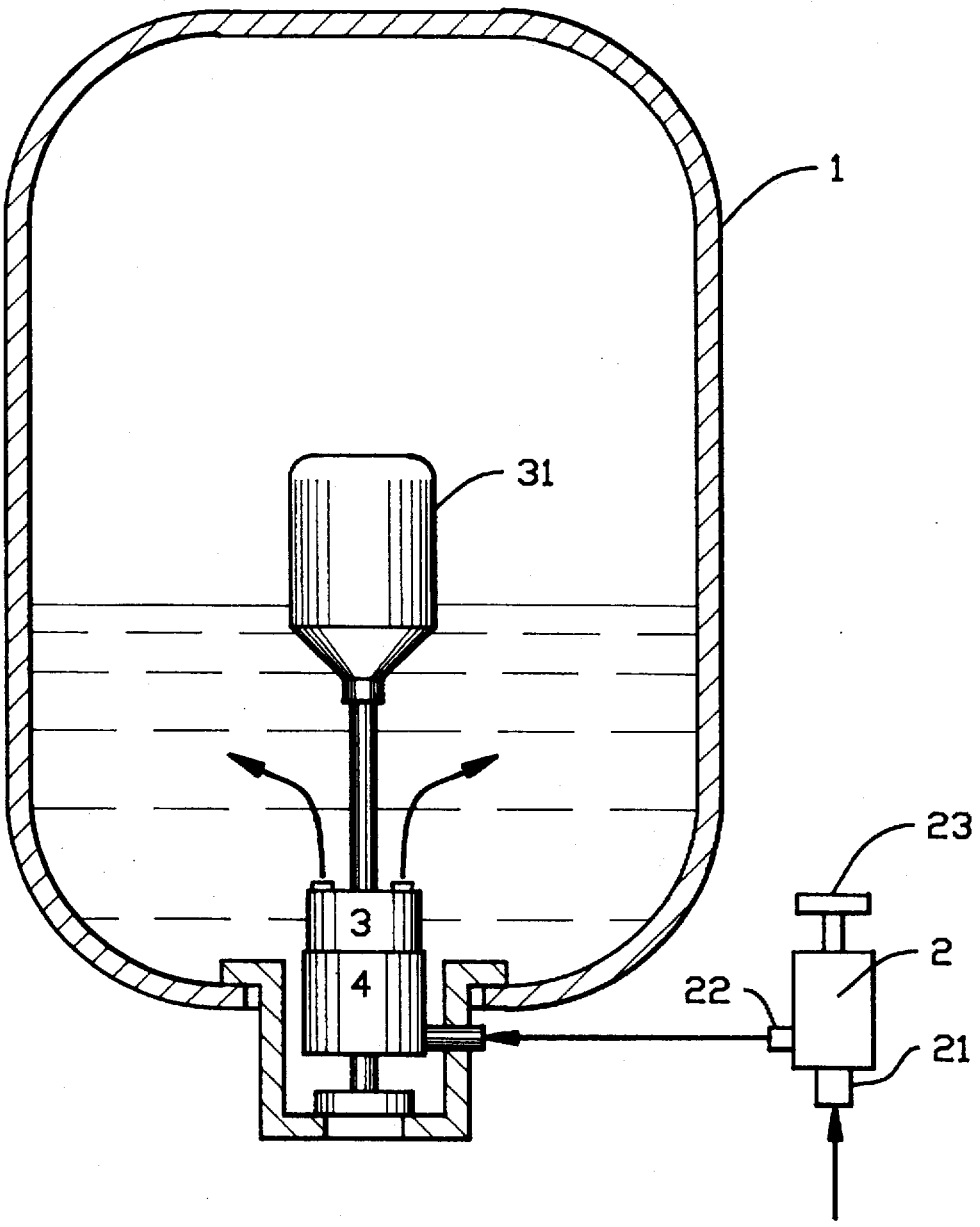
FIG. 1 is a schematic drawing, partly in section, of the flush system.

FIG. 1 is a schematic drawing of the disclosed flush system, which comprises an enclosed flush tank 1, a feed valve 2, a volume control device 3 and a flush valve 4. The feed valve 2 has an inlet port 21 connected to the supply water, an outlet port 22 leading to the flush tank 1 through the flush valve 4 and the volume control device 3. The discharge port of the flush valve 4 is connected to the inlet port of a toilet bowl.

The feed valve 2 is normally closed so that it isolates the flush tank from the supply water when the flush system is not used. The feed valve has an actuating button 23. A push on the actuating button 23 opens the feed valve and sends the supply water to the flush tank. The feed valve is so designed that once it opens, it stays open as long as the through flow exceeds a predetermined low flow threshold. When the flow reduces below this low flow threshold, the feed valve closes automatically to isolate the supply water from the flush system.

Figure 2:
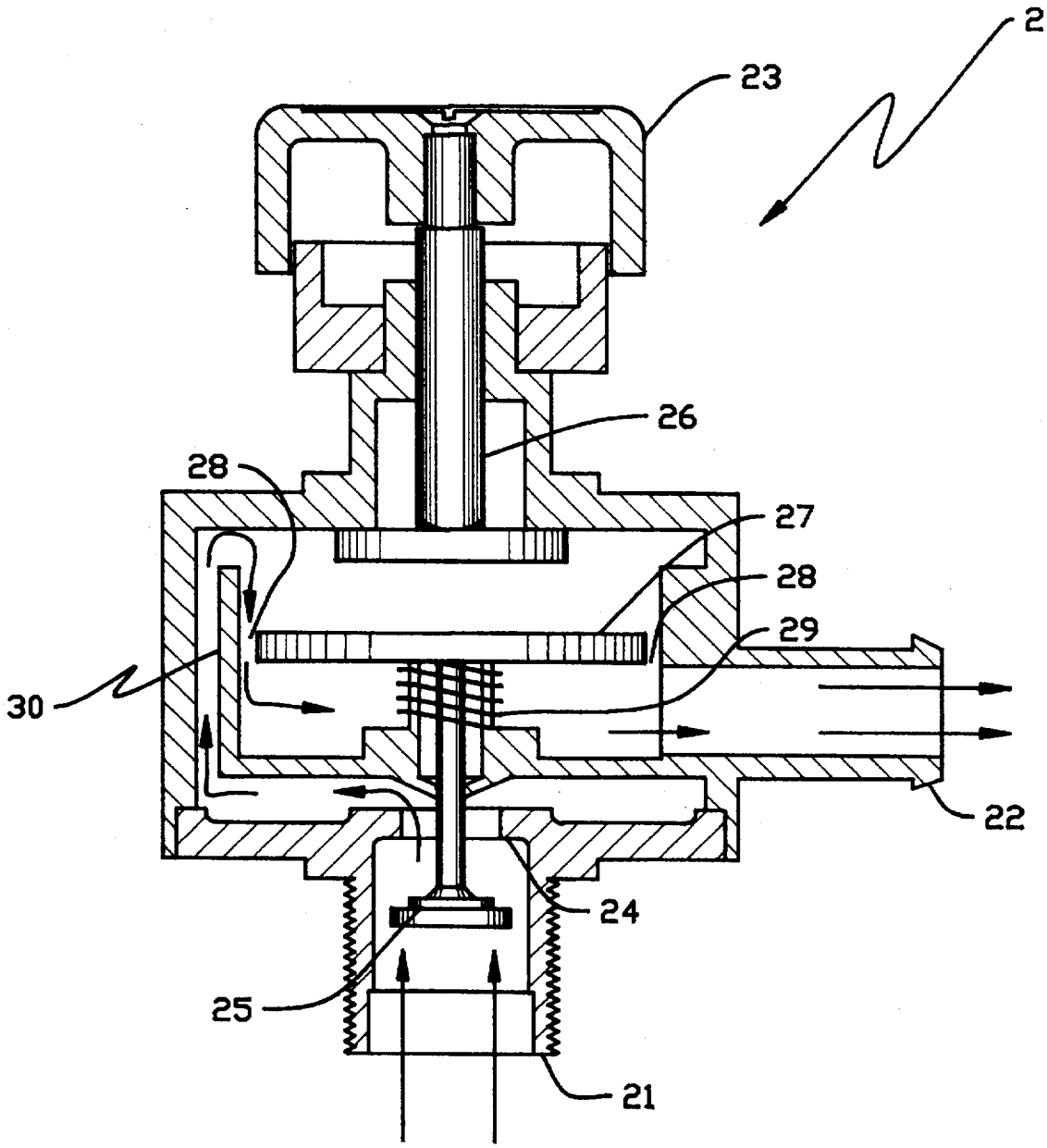
FIG. 2 is a cross-sectional view of the feed valve of the flush system.

A preferred embodiment of the feed valve is shown in FIG. 2, which has a valve seat 24 facing the incoming flow and has a movable plug 25 at the upstream side of the valve seat. The actuating button 23 is connected to a movable stem 26. The movable stem 26 is so positioned that an inward motion of the stem will push the movable plug 25 away from the valve seat 24 and thereby opens the valve. There is a disc 27 mechanically connected to the movable pug. The function of disc 27 is to generate a flow drag force to maintain the valve open. The flow path in the valve is so arranged that the through flow that passes through the narrow gap 28 between the edge of the disc 27 and the baffle 30 results in a drag force on the disc in the direction of pushing the movable plug 25 away from the valve seat 24. The mechanical spring 29 tends to pull the movable plug 25 toward the valve seat. After the plug 25 is pushed open and when the through flow is sufficiently high, the drag force overcomes the spring force and keeps the movable plug 25 away from the valve seat 24. When the through flow drops to a predetermined low flow threshold, the hydraulic drag force reduces to the degree that it can no long overcome the spring force. Then the spring retracts the movable plug 25 towards the seat 24 and consequently closes the valve.

Figure 3:
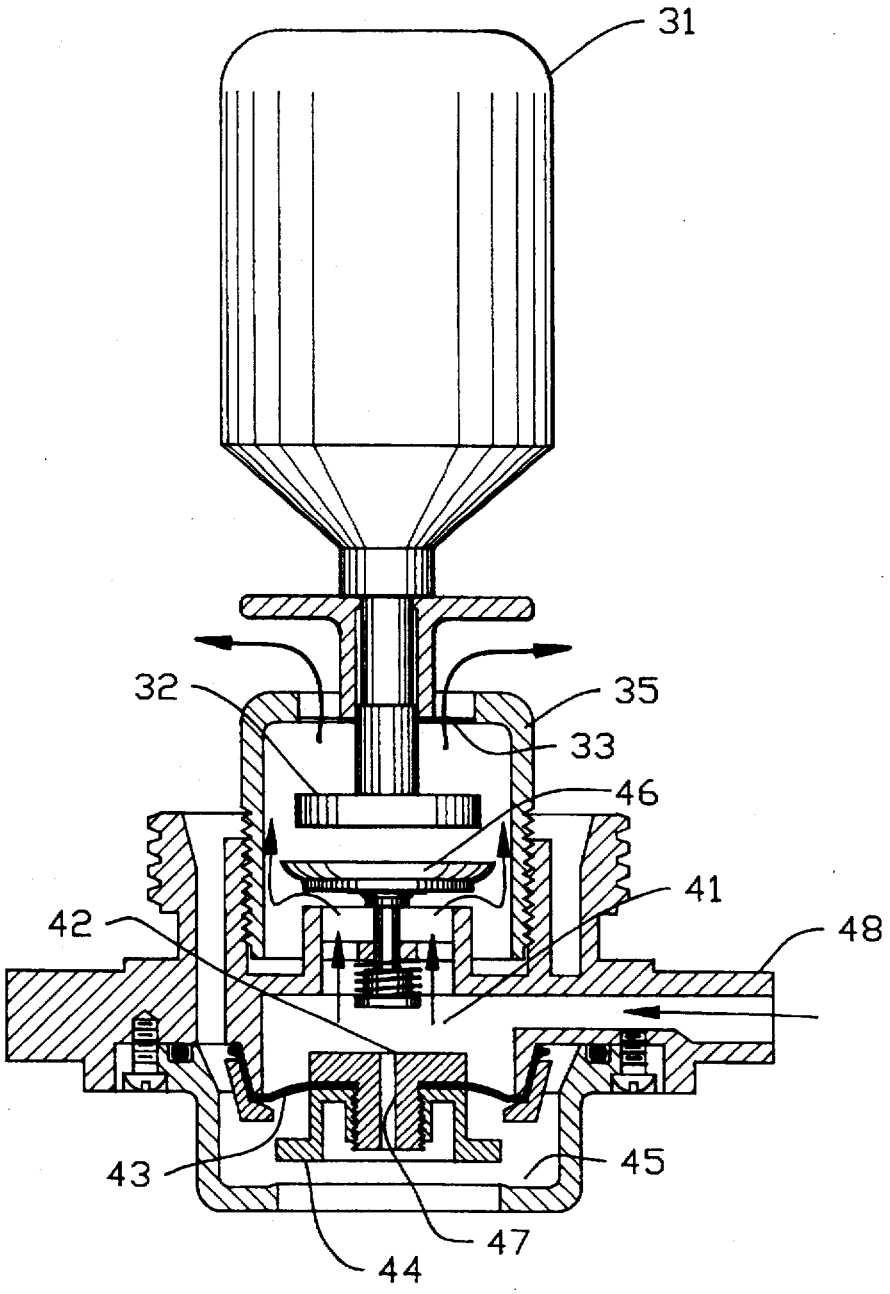
FIG. 3 is a cross-sectional view of the flush valve of the flush system in combination with the volume control device.

FIG. 3 shows a preferred embodiment of the combination of the volume control device and the flush valve in feed mode. The flush valve controls the discharge from the flush tank in response to the modes of the feed flow. When feed flow is on, it closes the discharge port of the tank that entraps the air in the flush tank and allows the feed water to be accumulated and compresses the entrapped air in the flush tank. When the feed water is off, the flush valve opens the discharge port to allow the accumulated tank water to the toilet. The flush valve comprises a feed and bleed chamber 41 that is hydraulically connected to the feed flow 48. The feed water is guided through chamber 41 and the check valve 46 to the volume control device and finally to the flush tank. The chamber 41 has a bleed port 42 with a narrow flow path 47 that communicates the interior of the chamber to the external pressure. Because the bleed port allows only a small bleed flow compared to the feed flow, the chamber can maintain a pressure substantially close to the feed water pressure when the feed water is on. There is a diaphragm 43 that seals the lower end of the pressure chamber. A valve plug 44 is affixed to the diaphragm in such a manner that the valve plug 44 engages to the valve seat 45 when the diaphragm extends outward from the chamber 41 and the plug disengages the seat when diaphragm retracts inward to chamber 41.

The function of the volume control device is to reduce the feed flow and initiate the feed valve closure when sufficient water is accumulated in the flush tank. The volume control device includes a valve housing 35 containing a movable plug 32, connected to the float 3. When the water level in the flush tank is low, the flow drops the movable plug to an open position that allows the feed flow to discharge freely through the opening 33 into the flush tank.

Figure 4:
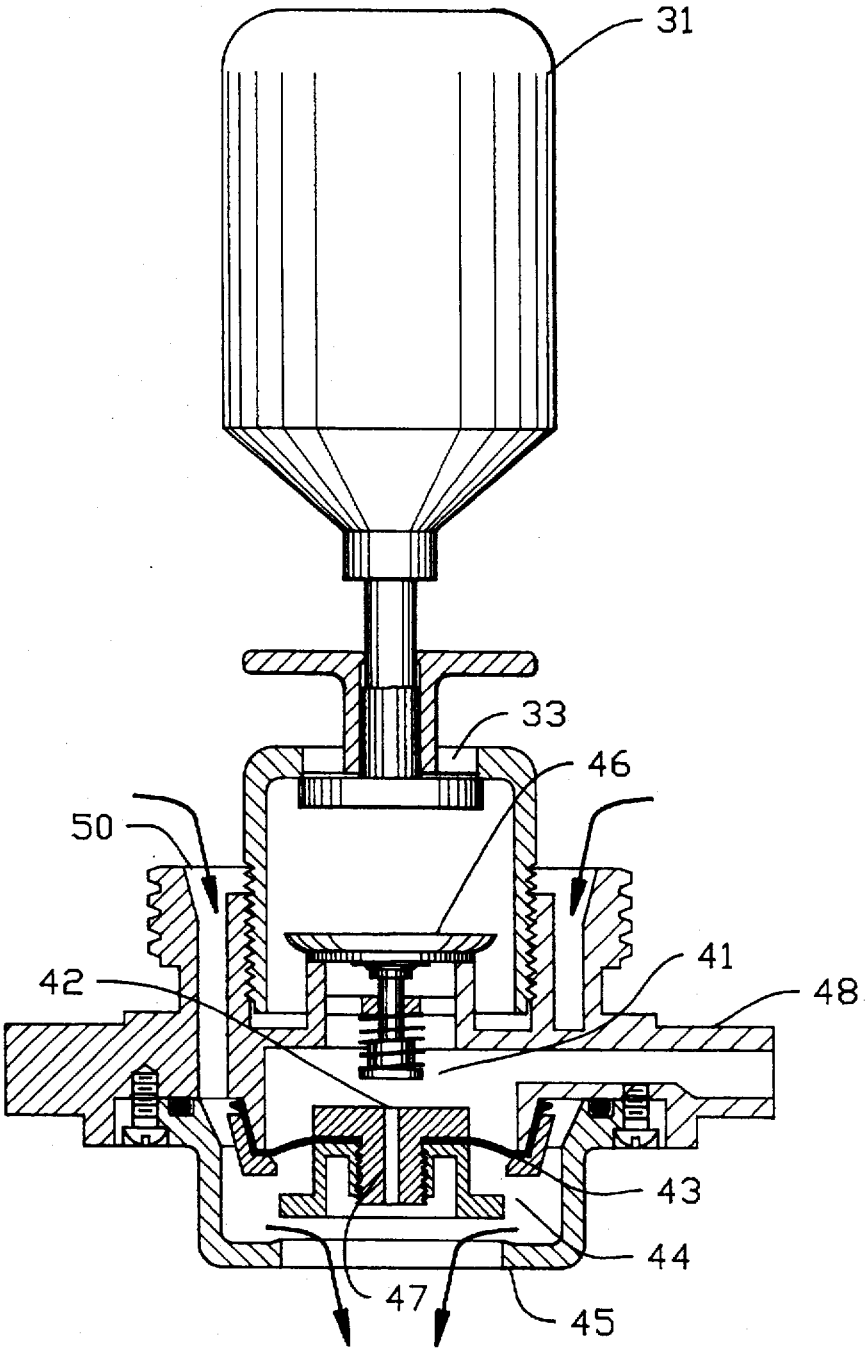
FIG. 4 is a view similar to FIG. 3 with parts in different positions.

When the water level rises to a predetermined high level, the buoyancy force of the float lifts the plug 32 to block the opening 33 as shown in FIG. 4. The blockage of the opening 33 causes the feed flow to reduce below the low flow threshold of the feed valve. Then the feed valve closes automatically in response to the flow reduction. After the closure of the feed valve, the feed to chamber 41 of the flush valve is cut off. In the meantime the check valve 46 closes automatically that prevents any flow back into chamber 41. Then, the only flow path still open for chamber 41 is the bleed flow path 47. Since the bleed path is open to the atmospheric pressure, chamber 41 is depressurized by a bleed flow through the bleed path 47. The depressurization of chamber 41 retracts the diaphragm 43, which consequently opens the flush valve to discharge the pressurized water from the flush tank through the flow path 50 and through the opening of the seat 45 to the toilet bowl.

I claim:

1. A toilet flush apparatus for a toilet bowl, comprising an enclosed flush tank for holding water and air under pressure, a feed valve for connecting a pressurized water supply source to said flush tank, volume control means for controlling the water volume of a flush, and a flush valve for connecting said flush tank to the toilet bowl to control water discharge from said flush tank to said toilet bowl, said feed valve having actuating means for opening said feed valve and consequently communicating a feed water flow from said water supply source to said flush tank, said feed valve remaining open when the flowrate of said feed flow is higher than a predetermined low flow threshold and closing automatically when said flowrate is reduced below said low flow threshold, said volume control means reducing said flowrate below said low flow threshold when a predetermined water volume is accumulated in said flush tank thereby causing the feed valve to close, said flush valve controlling the discharge flow from the flush tank to the toilet bowl in response to hydraulic conditions of both said feed water flow and pressurized water held in said flush tank such that when feed water flows, said flush valve closes automatically to allow the feed flow to be accumulated in said flush tank, and when said feed water flow stops, said flush valve opens automatically in response to the pressurized water in said flush tank to allow the water to discharge.

2. A toilet flush apparatus as in claim 1, wherein said feed valve comprises a valve seat facing incoming feed flow, a movable valve plug for opening and closing said valve seat, spring means mechanically connected to said valve plug for closing said valve seat, and a drag generating member so arranged that said feed flow generates a hydraulic drag force thereon which transmits to said movable plug to maintain the valve seat open when said flowrate is higher than said low flow threshold, said valve seat being closed automatically by said spring means when said flowrate decreases below said low flow threshold.

3. A toilet flush apparatus as in claim 1, wherein said flush valve comprises a valve seat, a movable plug for opening and closing said valve seat, a chamber including an inlet port connection to said feed flow, a check valve for preventing back flow into said chamber from said flush tank, a narrow bleeding flow path communicating to the exterior of said flush tank, said chamber being pressurized when said feed water is flowing and depressurized through said narrow bleed path when said feed water flow stops, and diaphragm means fitted in said chamber for driving said movable plug to close said valve seat when said chamber is pressurized and open said valve seat when said chamber is depressurized.

4. A toilet flush apparatus as in claim 1, wherein said volume control means comprises float closure means hydraulically connected to said feed flow and said flush tank through at least one flow opening for responding to flush tank water level, a valve housing to guide said feed flow through said flow opening, said float closure means including a valve plug connected mechanically to a float, said valve plug and float being arranged such that said valve plug disengages from said flow opening when the water in said flush tank is less than said predetermined volume, and blocks said flow opening when water is accumulated to said predetermined volume.

* * * * *